US010907897B2

(12) United States Patent
Swatkoski

(10) Patent No.: US 10,907,897 B2
(45) Date of Patent: Feb. 2, 2021

(54) VACUUM EXTRACTION OVEN

(71) Applicant: Vacuum Processes, Inc., Everett, PA (US)

(72) Inventor: John Swatkoski, Everett, PA (US)

(73) Assignee: VACUUM PROCESSES, INC., Everett, PA (US)

( * ) Notice: Subject to any disclaimer, the term of this patent is extended or adjusted under 35 U.S.C. 154(b) by 0 days.

(21) Appl. No.: 16/504,119

(22) Filed: Jul. 5, 2019

(65) Prior Publication Data

US 2020/0011598 A1 Jan. 9, 2020

Related U.S. Application Data

(60) Provisional application No. 62/694,255, filed on Jul. 5, 2018.

(51) Int. Cl.

*F26B 5/04* (2006.01)
*F26B 25/08* (2006.01)
*F26B 25/00* (2006.01)

(52) U.S. Cl.

CPC ..... *F26B 5/044* (2013.01); *F26B 25/002* (2013.01); *F26B 25/08* (2013.01)

(58) Field of Classification Search

CPC ..... F26B 5/00; F26B 5/06; F26B 5/08; F26B 25/00; F26B 25/08
USPC ..... 34/92, 284, 287
See application file for complete search history.

(56) References Cited

U.S. PATENT DOCUMENTS 3,260,783 A 7/1966 Potenzo et al.
3,521,373 A 7/1970 Pagnozzi
3,795,986 A * 3/1974 Sutherland ..... F26B 5/06 34/92
4,597,188 A * 7/1986 Trappler ..... F26B 21/14 34/287
6,058,625 A 5/2000 Kieselbach et al.
6,122,836 A * 9/2000 Tenedini ..... F26B 5/06 34/287

(Continued)

FOREIGN PATENT DOCUMENTS

CA 2849796 C * 4/2013
EP 2764311 B1 * 8/2014

(Continued)

OTHER PUBLICATIONS https://www.bestvaluevacs.com/categories/drying-ovens/vacuum-drying-ovens/best-value-vacs-lab-series.html Best Value Vacs; Youtech & Associates Chicagoland Creative Web Design (Publisher); 2017 Copyright.

*Primary Examiner* — Stephen M Gravini

(57) ABSTRACT

A device for drying organic substances under vacuum and altered temperature conditions, e.g. to extract particulates from the substance without significant damage to the substance. The device can contain a hollow vacuum oven to dry the organic substance. The substance is placed on the shelves in the vacuum chamber and the heaters below the shelves maintain the temperature uniformity to evenly heat the substance on the shelf. A vacuum feedthrough is connected on one side of the shelf for desired flow of the substance and the shelves themselves can be tilted for even drying. The vacuum pump, which can be used in high vacuum mode or gas flow mode then removes the particulates that evaporated from the substance and the condenser collects and condenses the unwanted or wanted particulates.

15 Claims, 3 Drawing Sheets

(56) References Cited

U.S. PATENT DOCUMENTS

| | | | | |
|---|---|---|---|---|
| 6,543,155 | B2 * | 4/2003 | Horigane | F26B 3/30 34/289 |
| 6,914,218 | B2 | 7/2005 | Vernik et al. | |
| 7,877,895 | B2 * | 2/2011 | Otsuka | H01L 21/67748 34/78 |
| 8,171,652 | B2 * | 5/2012 | Py | F26B 5/06 34/287 |
| 8,181,356 | B2 * | 5/2012 | Otsuka | H01L 21/67748 34/381 |
| 9,052,138 | B2 * | 6/2015 | DeMarco | F26B 5/065 |
| 10,465,985 | B2 * | 11/2019 | Ganguly | F26B 5/065 |
| 10,527,350 | B2 * | 1/2020 | Plitzko | F26B 25/002 |
| 2008/0229609 | A1 * | 9/2008 | Bronshtein | C12N 9/0006 34/287 |
| 2015/0069042 | A1 | 3/2015 | Serrago et al. | |
| 2018/0120027 | A1 * | 5/2018 | Ganguly | A23L 3/44 |
| 2020/0011598 | A1 * | 1/2020 | Swatkoski | F26B 5/044 |

FOREIGN PATENT DOCUMENTS

| | | | |
|---|---|---|---|
| FR | WO2017184642 | A1 | 10/2017 |
| JP | 5669989 | B2 * | 2/2018 |
| KR | 101504465 | B1 * | 3/2015 |

* cited by examiner

VACUUM EXTRACTION OVEN

CROSS-REFERENCE

This application claims the benefit of U.S. Provisional Application No. 62/694,255, filed Jul. 5, 2018, which application is incorporated herein by reference.

BACKGROUND OF THE INVENTION

Vacuum ovens are used to dry substances, e.g. substances that may be sensitive to heat using a vacuum process. Using vacuum ovens, the unwanted particulate matter is removed by reducing the pressure which in turn results in evaporation at a lower temperature, thus drying faster and with relatively stable and/or lower temperature. Common problems often associated with vacuum extraction ovens are uneven heating and small, rigid lab style ovens which are unsuited to use in industrial processes.

SUMMARY OF THE INVENTION

The present invention is directed to a vacuum oven to dry organic materials, e.g. under high vacuum conditions, in relatively low heat, and/or uniform heat. This can be done for several reasons, including in order to preserve the organic material. The disclosed invention consists of a vacuum chamber with shelves that have heaters below them that provide very uniform temperature with variations in temperature between 0.28 to 1.11 degrees Celsius. The substance to be dried is kept on the shelf and controls can be used to set the required temperature, pressure, and gas flow depending on the material to be dried. In some embodiments, high vacuum and relatively low temperature can be used to dry leaves for a specific medical purpose which may be damaged by the use of high temperature. The sprockets and levers connected to the shelves can be used to rotate the shelves up to 360 degrees in order to facilitate even heating and drying. The vacuum pump connected to a side of the vacuum chamber can be used in high vacuum or gas flow mode to collect the unwanted or wanted particulates from the organic material. In some embodiments, the vacuum pump can be used in high vacuum mode to collect all the particulates. In some embodiments, the vacuum pump can be used in gas flow mode which can be used to extract specific particulates from the organic material. Thus, specific particulates can be extracted from the organic material. A control mechanism enables measurement and regulation of temperature, pressure, and/or gas flow. This is a disclosure for a device that allows extraction of specific wanted or unwanted particulates from organic materials using high vacuum and relatively low temperatures so as to prevent damage to the material while extraction.

BRIEF DESCRIPTION OF THE DRAWINGS

The novel features of the invention and set forth with particularity in the appended claims. A better understanding of the features and advantages of the present invention will be obtained by reference to the following detailed description that sets forth one of the many illustrative embodiments, in which the principles of the invention are utilized.

DETAILED DESCRIPTION OF THE INVENTION

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention.

Figure 1:
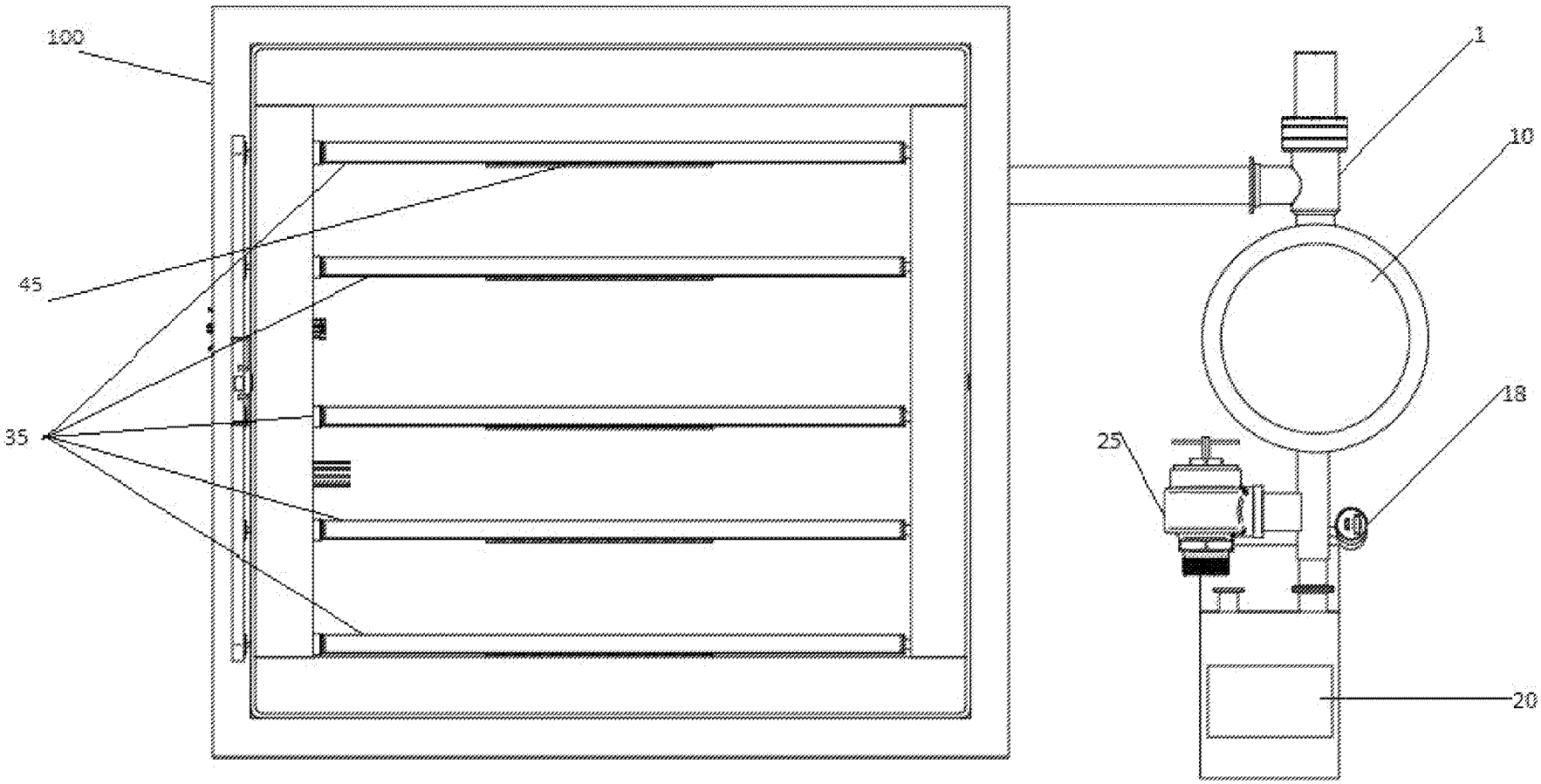
FIG. 1 is an illustration of an exemplary embodiment of a vacuum oven from a front view of the vacuum oven furnace chamber, depicting: shelves, condenser, vacuum gauge, vacuum valve, vent valve, and the vacuum pump.
Figure 2:
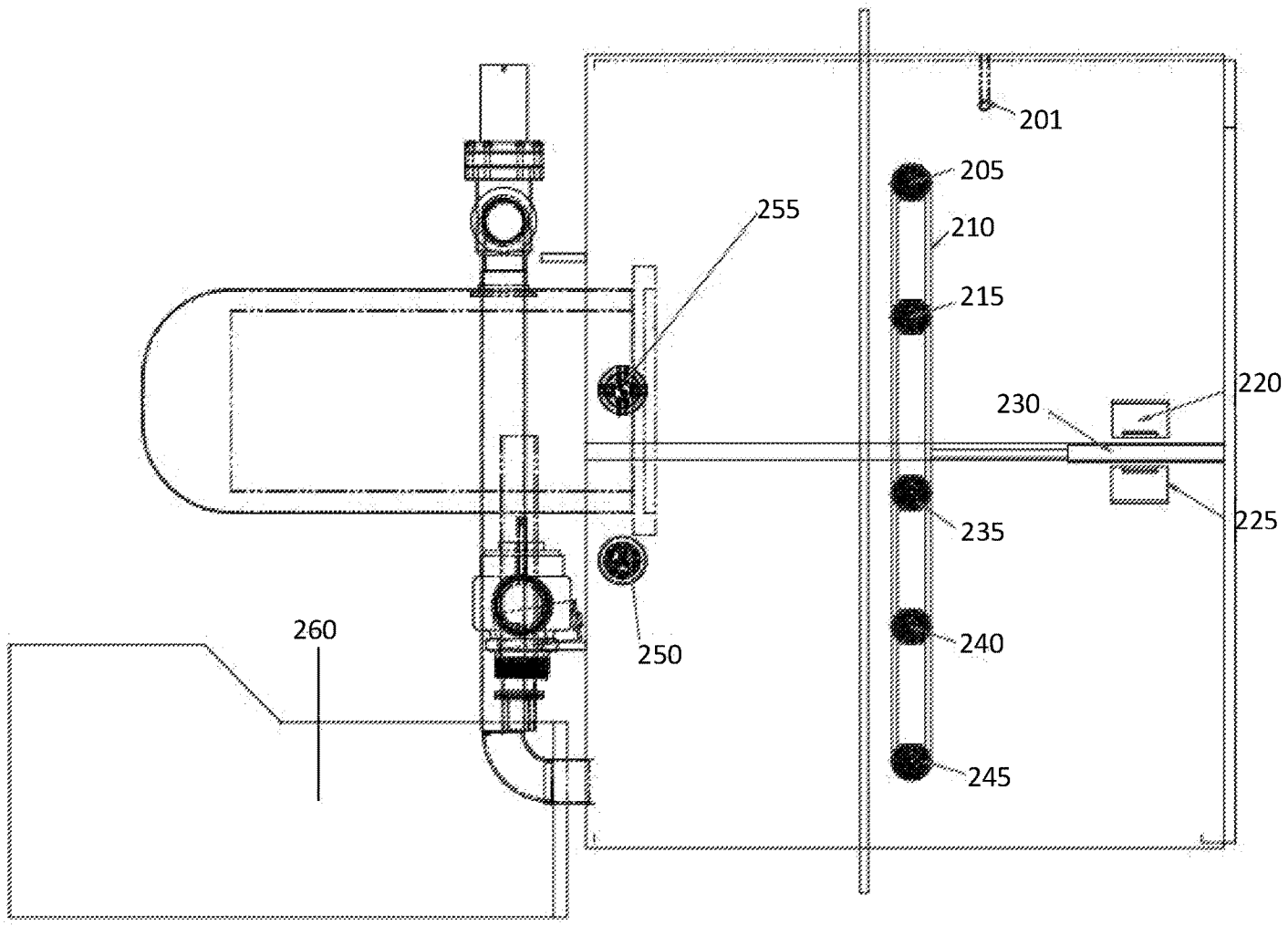
FIG. 2 is an illustration of an exemplary embodiment of a vacuum oven from a side (e.g. left) view of a drive area, depicting: sprockets which cover vacuum feedthrough, electric power feedthrough, thermocouple readouts, chain, and actuating lever.
Figure 3:
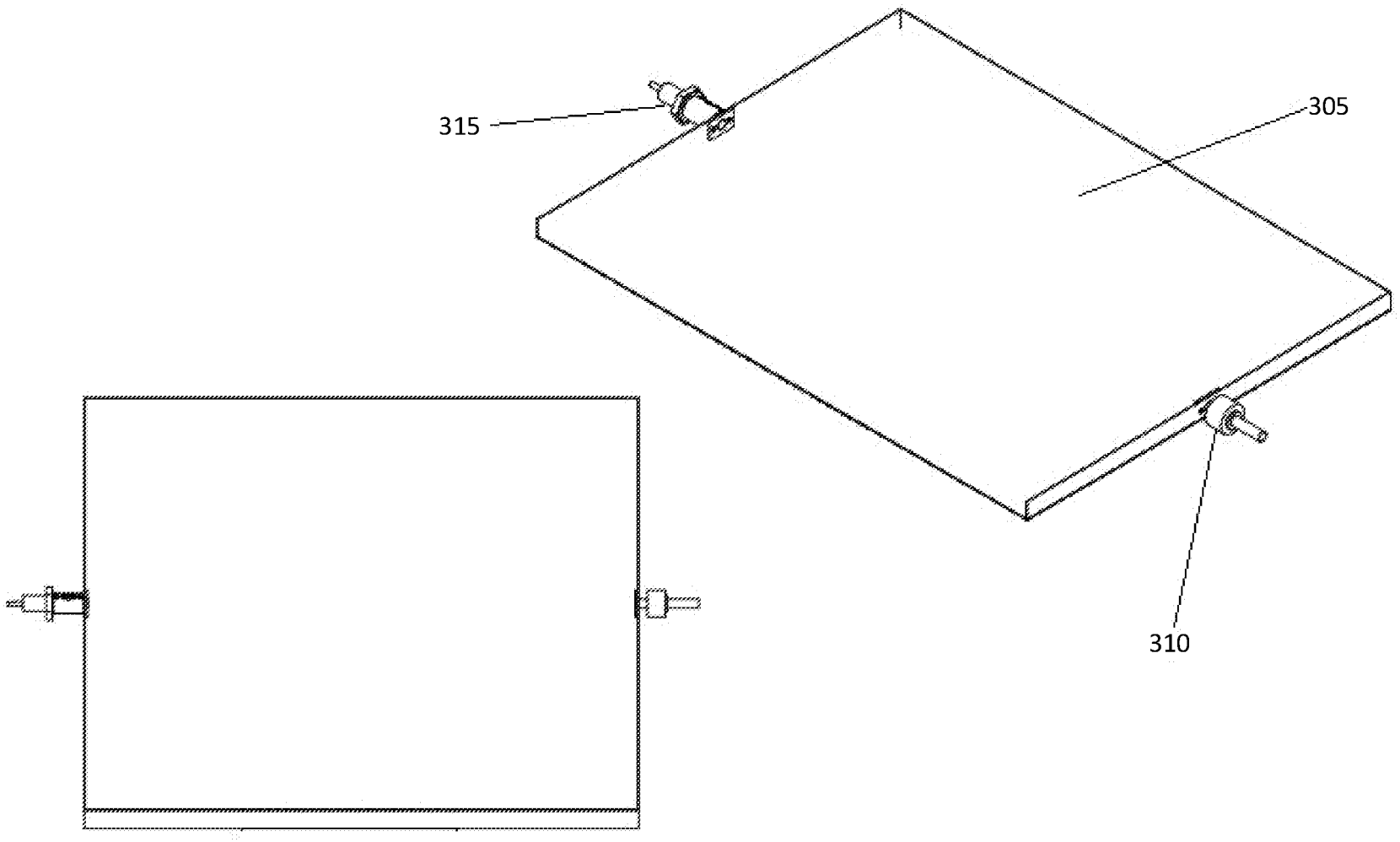
FIG. 3 is an illustration of an exemplary embodiment of a vacuum oven shelf, depicting the vacuum feedthrough on the left and a bushing assembly (e.g. made of Teflon or other material) on the right with a connecting rod.

FIG. 1-3 depict embodiments of a vacuum extraction oven and components thereof. In FIG. 1, the extraction oven can comprise: a vacuum chamber (100) which may contain shelves (35) with heaters (45), e.g. attached below the shelves. The driven end of the shelves can be connected to vacuum feedthrough, electric feedthrough and/or thermocouple feedthrough. The shelves can be connected to a vacuum chamber via a connecting pipe, which can be attached to a vacuum valve (1) assembly, e.g., for control of vacuum conditions, including high vacuum conditions. The vacuum valve (1) can be connected to a condensing unit (10) which can be connected to a vacuum pump 20 in order to remove or collect all the wanted or unwanted particulates.

In FIG. 2, sprockets (205) are mounted over the vacuum feedthrough on the outside of the vacuum chamber and have levers (230) that may be used to rotate the shelves to regulate the flow of the material in any direction.

A vacuum chamber can be a hollow chamber that may be of any shape that can stay stable, e.g. on a flat surface with an opening to access the interior of the chamber. In some embodiments, the chamber may be any curved shape allowing the chamber to rest on a flat surface. In some embodiments, the chamber may be four-sided with one side having an opening to the interior of the chamber.

A vacuum chamber can be made of any material that can withstand high heat or high vacuum. In some embodiments, the chamber is made of steel. In some embodiments, the vacuum chamber is made of stainless steel.

A vacuum chamber can have an opening to access the interior of the chamber. The opening can be made from the same material as the chamber or from any other material that is able to withstand high heat and high vacuum. In some embodiments, the opening can be made of a ceramic material that can withstand high vacuum conditions. In some preferred embodiments, the opening can be made of glass that is semi or completely transparent, or use a glass viewing port on the door.

A vacuum chamber may be of any size suitable for use in creating a suitable vacuum. In some embodiments the vacuum chamber is at least 0.03 cubic meters and the size can be based on the intended usage of the extraction oven. In some preferred embodiments, the vacuum chamber may be between 0.03 to 1 cubic meters in size. In some embodiments, the vacuum chamber is larger than 1 cubic meter.

A vacuum chamber may comprise 1 or more shelves inside. In some preferred embodiments, the vacuum chamber comprise 5 or more shelves. In some embodiments, the vacuum chamber may comprise 4 or more shelves. In some embodiments, the vacuum chamber comprises 3 or more shelves. In some embodiments, the vacuum chamber comprises 2 or more shelves.

The shelves can be made of any material able to withstand high heat and high vacuum. In some embodiments, the shelves may be made of steel. In some embodiments the shelves may be made of aluminum. In some embodiments, the shelves may be made steel coated with polytetrafluoroethylene. In some preferred embodiments, the shelves may be made of stainless steel which can be coated with polytetrafluoroethylene.

The shelves can have a heating element, e.g. attached to one side of the shelf. The organic material to be dried may be preferentially restricted to an area not directly contacting the heating element.

The heating element may be covered with a thin layer of a protective material on the side not touching the shelf, e.g. in order to protect the heating element and/or to prevent the organic material from coming in contacting directly with the heating element. In some embodiments, the heating element may be coated in a protective coating to protect the heating element. In some embodiments, the heating element may be coated in polytetrafluoroethylene to protect it. In some preferred embodiments, the heating element may be coated in stainless steel to protect it.

The heating element can be made of any material with electric resistance that is able to withstand high temperature and/or high vacuum. In some embodiments, the heating element is comprised of a material that has a high electric resistance, e.g. to produce heat. In some embodiments, the heating element may be made of an alloy of chromium and iron. In some embodiments, the heating elements may be made of an alloy of iron-chromium-aluminum. In some preferred embodiments, the heating element may be made of an alloy of nickel and chromium.

The heating element below each shelf can be of any shape depending on the intended use of the extraction oven. In some embodiments, the heaters could be shaped like a coil. In some embodiments, the heaters may be flat shaped like the shelf itself. In some embodiments, the heating element may be serpentine shaped.

The heating element below each shelf can be of any reasonable thickness depending on the use of the extraction oven. In some embodiments, the heating element could have a thickness of more than 0.1 mm.

The heaters below the shelf may be set to heat at a specific temperature and can maintain temperature uniformity in a precise manner. By precise, the set temperature can be maintained within a small range above and below the set temperature. In some embodiments, the shelf heaters may maintain a temperature within: +/−0.2 degrees Celsius or less of the set temperature; +/−0.28 degrees Celsius or less of the set temperature, +/−0.4 degrees Celsius or less of the set temperature; +/−0.5 degrees Celsius or less of the set temperature; +/−0.6 degrees Celsius or less of the set temperature; +/−0.7 degrees Celsius or less of the set temperature; +/−0.8 degrees Celsius or less of the set temperature; +/−0.9 degrees Celsius or less of the set temperature; +/−1.0 degrees Celsius or less of the set temperature; +/−1.1 degrees Celsius or less of the set temperature; +/−1.2 degrees Celsius or less of the set temperature; +/−1.3 degrees Celsius or less of the set temperature; +/−1.3 degrees Celsius or less of the set temperature; +/−1.4 degrees Celsius or less of the set temperature; +/−1.5 degrees Celsius or less of the set temperature; +/−1.6 degrees Celsius or less of the set temperature.

The driven end of the shelf may be attached to a vacuum feedthrough. In some preferred embodiments, the vacuum feedthrough may be designed for use in high vacuum conditions. In some embodiments, the vacuum feedthrough may be designed for use in a vacuum or partial vacuum (e.g. 0 atmospheric pressure or more).

A vacuum feedthrough can be attached to a sprocket on the outer side of the vacuum chamber. The sprocket may be connected to a lever which can rotate the shelves in any direction. In some embodiments, the shelves may be rotated individually. In some preferred embodiments, the shelves may be rotated at the same time.

The lever may be used to rotate the shelf up to 360 degrees (e.g. a full rotation) or less. In some embodiments, the shelf may have a maximum rotation of less, e.g. such as 180 degrees or less, 150 degrees or less, 100 degrees or less, 90 degrees or less, 45 degrees or less, 30 degrees or less, 20 degrees or less, 10 degrees or less, 5 degrees or less, 1 degree or less or the shelf may be substantially fixed (e.g. not able to rotate). In some preferred embodiments, to prevent the fall of the material off the shelf, the lever may be used to rotate the shelf up a maximum of 5 degrees.

A vacuum pump can be connected on one side of the vacuum chamber using polytetrafluoroethylene bushing. In some embodiments, the vacuum chamber can be connected to the same side as the vacuum feedthrough. In some preferred embodiments, the vacuum pump is connected to the captured end of the shelf on the side across from the vacuum feedthrough.

The vacuum pump may be of any type. In some embodiments, it may be a liquid ring vacuum pump. In some embodiments, it may be an oil vacuum pump. In some preferred embodiments, it may be a dry vacuum pump to increase longevity and reduce the expense of replacing any liquid, or lubrication.

In some embodiments, the vacuum pump may be used in a substantially full vacuum, e.g. at 0-0.1 atmospheric pressure. In some embodiments, the vacuum pump may be used in partial vacuum, e.g. 0.1 up to 1 atmospheric pressure (i.e. 14.7 pounds per square inch), or with special additions higher pressures.

The vacuum pump is connected to a condenser that cools the particulates pulled from the vacuum chamber. In some embodiments, the condenser is connected to the vacuum pump which is connected to the vacuum chamber. In some preferred embodiments, the condenser is connected to the between the vacuum chamber and the vacuum pump in order to protect the vacuum pump from any damage.

The condenser may be used in different modes. In some embodiments, the condenser may be used in vacuum mode to collect all particulates. In some embodiments, the condenser may be used in gas mode to create pressure from about 0 atmospheric pressure up to 1 atmospheric pressure.

The extraction oven may include a control mechanism that could allow for temperature control, vacuum pump and valve control, gas flow control, and/or temperature control. In some embodiments, the control mechanism may be operated manually. In some preferred embodiments, the control mechanism may be operated automatically using a set of predefined commands, and actuators.

In some embodiments, the control system may be mounted on the extraction oven. In some preferred embodiments, the control system may be placed some distance away from the extraction oven.

What is claimed is:

1. A vacuum extraction oven comprising:

a hollow vacuum chamber and one or more shelf assemblies;

the hollow vacuum chamber defining an interior of the vacuum chamber;

each shelf assembly of the one or more shelf assemblies comprising a shelf and a lever, the shelf being disposed in the interior of the vacuum chamber, the shelf comprising opposite sides extending between opposite ends of the shelf, the shelf being rotatably supported in the vacuum chamber at the opposite ends of the shelf, the shelf being rotatable for at least limited angular displacement about a fixed axis of rotation extending through the opposite ends and between the opposite sides of the shelf wherein the opposite sides of the shelf remain on opposite sides of the axis of rotation with angular displacement of the shelf, the lever being disposed outside of the vacuum chamber and being connected to the shelf, the lever being movable with respect to the vacuum chamber and being connected to the shelf whereby movement of the lever generates angular displacement of the shelf about the axis of rotation of the shelf;

a condenser connected to a vacuum pump that collects an extracted particulate matter, the vacuum pump being fluidly connected to the interior of the vacuum chamber by a vacuum valve; and a control mechanism to measure and control one or more aspects selected from a group consisting of: vacuum pressure, temperature, valve pressure, gas flow, and any combination thereof.

2. The vacuum extraction oven of claim 1 wherein the one or more shelf assemblies comprise two or more shelf assemblies, the lever being a common lever for each of the two or more shelf assemblies whereby movement of the lever generates simultaneous angular displacement of each shelf of the two or more shelf assemblies.

3. The vacuum extraction oven of claim 1 wherein the one or more shelf assemblies comprise two or more shelf assemblies, the lever of each of the two or more shelf assemblies being a lever separate from the levers of the other of the two or more shelf assemblies whereby movement of the lever generates angular displacement of only the shelf attached to the lever.

4. The vacuum extraction oven of claim 1 wherein each shelf assembly of the one or more shelf assemblies comprises a heating element attached to one side of the shelf.

5. The vacuum extraction oven of claim 1 wherein the shelf of each of the one or more shelf assemblies is rotatable by not more than 5 degrees about the axis of rotation.

6. The vacuum extraction oven of claim 1 wherein the shelf of each of the one or more shelf assemblies is rotatable by not more than 90 degrees about the axis of rotation.

7. The vacuum extraction oven of claim 1 wherein the shelf of each of the one or more shelf assemblies is rotatable by more than 90 degrees about the axis of rotation.

8. The vacuum extraction oven of claim 1 wherein the lever is automated.

9. The vacuum extraction oven of claim 1 wherein the lever is manually operated.

10. The vacuum extraction oven of claim 7 wherein the shelf of each of the one or more shelf assemblies is rotatable by 360 degrees about the axis of rotation.

11. The vacuum extraction oven of claim 1 wherein each shelf of the one or more shelf assemblies is attached to a respective vacuum feedthrough extending from the shelf and out of the vacuum chamber.

12. The vacuum extraction oven of claim 1 wherein the one or more shelf assemblies comprises two or more shelf assemblies, each shelf assembly of the two or more shelf assemblies comprising a sprocket being disposed outside of the vacuum chamber, the sprocket being connected to the shelf of the shelf assembly and conjointly displaceable with the shelf, the sprocket being mounted over the vacuum feedthrough attached to the shelf;

the sprockets of the two or more shelf assemblies forming a portion of a common chain drive that simultaneously drives angular displacement of the shelves of the two or more shelf assemblies.

13. The vacuum extraction oven of claim 1 wherein the shelf of each of the one or more shelf assemblies is at least partially supported in the interior of the vacuum chamber by a vacuum feedthrough at one end of the shelf and by a bushing at the other end of the shelf.

14. The vacuum extraction oven of claim 1 wherein the control mechanism is located separate from the vacuum chamber.

15. The vacuum extraction oven of claim 1 wherein the control mechanism is mounted on the vacuum chamber.

* * * * *